United States Patent [19]

Gardiner et al.

[11] 4,158,564

[45] Jun. 19, 1979

[54] METHOD AND APPARATUS FOR CONTROLLING THE GRAY SCALE RESPONSE OF A MULTILAYER IMAGE FORMING SCREEN

[75] Inventors: Kenneth W. Gardiner, Menlo Park; Gerald L. Pressman, San Jose, both of Calif.

[73] Assignee: Electroprint, Inc., Sunnyvale, Calif.

[21] Appl. No.: 868,098

[22] Filed: Jan. 3, 1978

Related U.S. Application Data

[63] Continuation of Ser. No. 774,363, Apr. 4, 1977, abandoned, which is a continuation of Ser. No. 442,698, Feb. 15, 1974.

[51] Int. Cl.[2] ..... G03G 13/048

[52] U.S. Cl. ..... 96/1 R; 355/3 SC

[58] Field of Search ..... 96/1 R, 1.5; 355/3 SC

[56] References Cited

U.S. PATENT DOCUMENTS

| | | | |
|---|---|---|---|
| 3,582,206 | 6/1971 | Burdige | 96/1 R X |
| 3,647,291 | 3/1972 | Pressman | 355/3 SC |
| 3,680,954 | 8/1972 | Frank | 355/3 SC |
| 3,713,734 | 1/1973 | Crane et al. | 355/3 SC |
| 3,737,222 | 6/1973 | Briggs et al. | 355/3 SC |
| 3,797,926 | 3/1974 | Fotland et al. | 355/3 SC |
| 3,942,980 | 3/1976 | Hou | 96/1 R X |

*Primary Examiner*—John D. Welsh

*Attorney, Agent, or Firm*—Townsend and Townsend

[57] ABSTRACT

An electrostatic latent image is impressed on a multilayer apertured screen to establish within the apertures electric fields that modulate the passage of charged particles through the screens so that the charged particles are distributed in correspondence with the image. After imaging the screen is operated to control the gray scale response thereof in order to optimize copy quality. The gray scale screen response is expanded by applying a bias voltage of at least two different values to the screen during the duplication interval. The response is limited by altering the latent image charge to provide a high density cutoff and by applying a bias voltage to establish a low density cutoff during the duplication interval. Copy quality is further improved by adjusting the integrated charged particle current to establish the desired degree of density in regions of the copy image corresponding to high density regions of the original image.

7 Claims, 14 Drawing Figures

METHOD AND APPARATUS FOR CONTROLLING THE GRAY SCALE RESPONSE OF A MULTILAYER IMAGE FORMING SCREEN

This is a continuation of application Ser. No. 774,363, filed on Mar. 4, 1977, now abandoned, which is a continuation of application Ser. No. 442,698, filed Feb. 15, 1974.

This invention relates to a method and apparatus for controlling the tonal response of an apertured multilayer image-forming screen of the type interposed between a stream of charged particles and a medium (e.g., paper) toward which the charged particles are propelled to form an image on the medium.

In operating a multi-layer apertured screen of the type disclosed in U.S. Pat. No. 3,713,734 for Method and Apparatus for Forming a Positive Electrostatic Image, a photoconductive layer of the screen is impressed with an electrostatic latent image of a picture or pattern to be reproduced so that the charge level on the screen, or the potential difference between opposite surfaces of the photoconductive layer, is proportional to the density of the image. As explained in more detail in the cited patent, the charge on the photoconductive layer determines the magnitude and/or polarity of the field within an aperture through the screen so that the number of charged particles passing through an aperture bears a relation to the density of the image or picture at a corresponding location. Thus a dielectric medium placed behind the screen receives a charge pattern corresponding to that of the picture or pattern to be reproduced.

Faithful and linear reproduction is achieved so long as there is a monotonic relationship between the charge pattern that can be impressed and stored on the photoconductive layer and the charged particle pattern impressed and stored on the dielectric medium. The latter pattern is determined by the total amount of charged particles incident to the apertured screen during the duplication interval when the latent image on the screen is being duplicated on the dielectric medium and the control of charged particle flow during the duplication interval produced by the electric field created within the screen apertures.

It has been found that as the physical size of the screen apertures is reduced in order to achieve finer resolution of reproduction, the range of control provided by the field within the aperture between the maximum and minimum value is narrower than the range of charge variations on the photoconductive layer and the screen becomes saturated at one or both extremes. Now a typical pattern or picture has completely white or transparent portions, completely black or opaque portions, and a continuous gradation of gray tones between the two extremes. All gradations of tone are not reproduced, however, when the range of charged particle control within the apertures is not co-extensive with the range of charges on the photoconductive layer. In such a case, if a range of operation is selected that accurately reproduces the white or transparent portions of the pattern or picture, the portions of the picture that range in tone from some intermediate portion of the gray scale to black will all be reproduced as black or opaque portions since further control is not possible beyond the upper limit of the charged particle control range. Similarly, if a range of operation is selected that accurately reproduces the black portions of the picture, those portions of the picture that range in tone from some intermediate portion of the gray scale to white will all be reproduced as white or transparent portions since further control is not possible below the lower limit of the charged particle control range. Corresponding, if a middle range of operation is selected, those portions of the picture or pattern that range in tone from white to light gray will reproduce as white and portions of the picture that range in tone dark gray to black will reproduce as black.

Although it is theoretically possible to avoid the above-described saturation condition within the screen apertures by confining the photoconductive layer charge within a range equal to the limited charged particle control range provided by the screen, such a reduction of the charge range in the photoconductive layer renders the system more sensitive to electrical noise, which is manifested by graininess or mottling on the prints. Thus, in applications requiring a faithful reproduction of the original image over the entire gray scale it has heretofore been necessary to sacrifice the fineness of image resolution obtainable with smaller apertured screens in order to provide the desired gray scale screen response.

It has further been found that even with an apertured screen possessing a charged particle control range sufficiently broad to encompass the range of tones of an original image to be reproduced, the reproduced image may still exhibit a range of tonal resolution which is inferior to the original. Thus, black portions of an original may develop as medium or light grey portions, while the intermediate tonal portions of the original image may exhibit a shift toward the white end of the tonal resolution scale. Thus, even though fineness of resolution has been sacrificed, the reproduced image still does not possess the desired tonal range.

On the other hand, not all original images can be optimally reproduced with the above-noted electrostatic printing technique by providing a screen possessing a charged particle control range corresponding to a broad gray scale. For example, if a document to be reproduced has a faded text on a dirty background, faithful reproduction produces a copy having the same poor quality. To optimally reproduce an original of poor quality, the contrast ratio should be improved and the gray scale shifted so that the text appears darker on a lighter background. Moreover, this must be done in such a way that the reproduction of a good quality original having dark, well-defined text on a white background will not be adversely affected. Efforts in the past to reconcile the above-noted conflicting objectives have not met with wide success.

SUMMARY OF THE INVENTION

The invention comprises a method and apparatus for controlling the tonal resolution range of an electrostatic printer with an apertured multilayered screen in order to produce optimum copies of originals of varying quality. In another aspect of the invention an electrostatic printer having an apertured multi-image forming screen is operated in such a manner as to provide a reproduced image having a tonal range which corresponds to that of the original image. This is achieved by varying the integrated charged particle current in such a manner that the darkest portions of the reproduced original image are reproduced with the desired density. As defined herein the term "integrated charged particle current" is the total quantity of charged particles incident to the apertured screen during the duplication interval. In one embodiment of the invention the rate of charged particle emission from the source is varied to establish the desired integrated current; in another embodiment the duration of the duplication interval is varied to achieve the same result.

In still another aspect of the invention, an electrostatic printer with an apertured multilayered screen is operated in such a manner as to limit the substantially linear screen response to a range intermediate the extreme limits of the gray scale and to provide saturated response outside this intermediate range. This is accomplished by impressing a latent electrostatic image on the screen, reducing the image potential to a predetermined maximum value corresponding to a predetermined upper density cutoff, and biasing the screen to provide a predetermined lower density cutoff so that image regions lying below the lower density limit are reproduced with minimum intensity and image regions corresponding to regions of the original image lying above the upper density limit are reproduced with maximum intensity.

For a fuller understanding of the nature and advantages of the invention, reference should be had to the ensuing detailed description taken in conjunction with the accompanying drawings.

DESCRIPTION OF THE PREFERRED EMBODIMENT

Figure 1:
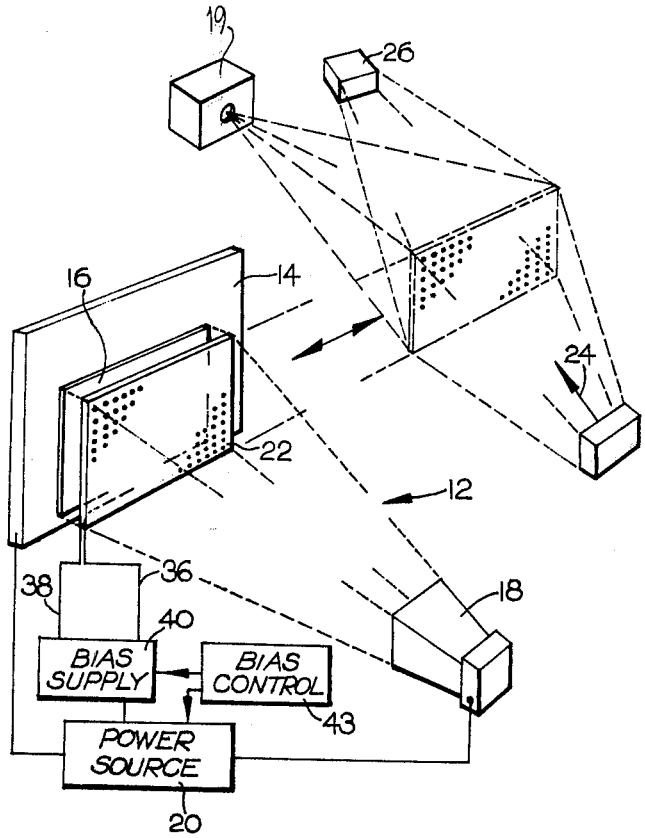
FIG. 1 is a diagrammatic view of an electrostatic printing system employing the present invention.

Referring more particularly to the drawings, reference numeral 12 indicates an electrostatic printing system that incorporates the present invention. The system includes an electrode plate 14 for supporting a suitable dielectric medium 16 on which an image is to be reproduced. Medium 16 is typically a piece of paper. A source of charged particles 18 is provided for supplying charged particles to be propelled toward medium 16, the propelling force being provided by a power source 20 which biases electrode plate 14 with respect to charged particle source 18 so that the particles are propelled toward the electrode plate. Interposed in the path of charged particles from source 18 to medium 16 is a multilayer apertured screen 22, such as is described in more detail in the aforecited patent. Screen 22 has a plurality of apertures therein in which apertures are formed electric fields that pass or block charged particles in a pattern that corresponds to a picture pattern to be reproduced on medium 16.

As described in more detail in the above cited copending U.S. patent, a charge pattern or electrostatic latent image is formed on screen 22, typically at a location remote from medium 16 as indicated by broken lines in FIG. 1, by first bombarding the screen with charged particles such as air ions from a source 24 thereby establishing on the reverse face of the screen a uniform double-layer charge across the photoconductive layer. Thereafter the image of the picture or pattern to be reproduced is projected from a projector 26 on to the photoconductive layer so that the photoconductive layer is locally discharged to a degree proportional to the light intensity of the image. An electrostatic double-layer charge latent image of the pattern is thereby established on the screen. The screen is then moved back to the solid line position shown in FIG. 1 after which charged particles from source 18 are directed toward the screen so that a corresponding image is formed on medium 16. Since the completion of the reproduction on medium 16 is not part of the invention, it suffices for the present to say that toner particles of suitable color are applied to the charge pattern on medium 16 and adhere thereto in correspondence with the intensity of the image formed on the medium. Thereafter the toner particles are fixed or fused in accordance with known technology.

In the present specification and claims "charged particles" is intended to encompass ions as well as charged particles of toner material that can be projected through screen 22 so as to dispense with a subsequent toner particle application step.

Figure 2:
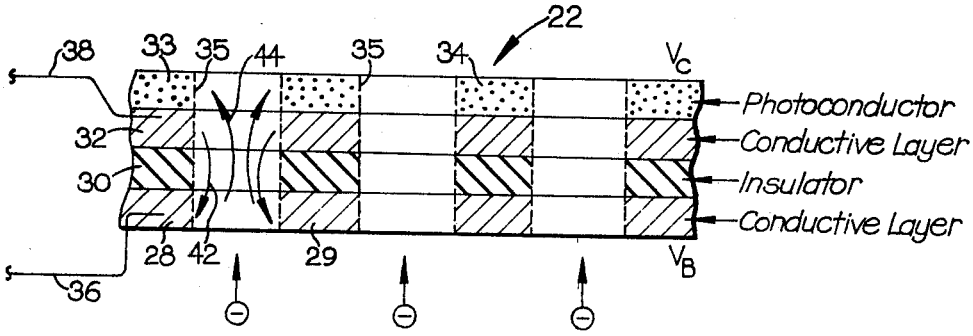
FIG. 2 is a diagrammatic view in cross section of a fragment of a multi-layer apertured screen of the type with which the present invention finds utility.

Referring to FIG. 2, screen 22 is a multi-layer screen that includes an outer conductive layer 28 one surface of which defines the obverse face 29 of the screen. Abutting layer 28 is an insulative layer 30 followed by another conductive layer 32 on which is disposed a photoconductive layer 33. The exposed surface of layer 33 defines the reverse face 32 of the screen. Apertures 35 are formed in the screen and each of the previously enumerated layers bounds each of the apertures to permit establishment and control of fields within respective apertures. A conductor 36 is connected to layer 28 and a conductor 38 is connected to layer 32; conductors 36 and 38 are in turn connected to a bias voltage supply source 40 which biases the electrodes with respect to one another and with respect to the field between charged particle source 18 and medium 16 such that a field indicated by field lines 42 is formed in apertures 35. The effect of the field indicated by lines 42 is to block particles as they approach the aperture so as to prohibit passage of the particles through screen 22. The voltage imposed on conductive layer 28 through conductor 36 is referred to hereinafter as $V_B$. For controlling the magnitude of $V_B$ according to this invention a conventional bias control circuit 43 is provided and has connections to bias supply 40 and power source 20.

When photoconductive layer 33 is initially charged from source 24 and is maintained in a dark or unexposed state, a substantial charge is established across the photoconductive layer 33, i.e., a voltage exists between conductive layer 32 and the reverse face 34 of the screen. Such voltage will be referred to hereinafter as $V_C$. Voltage $V_C$ creates in apertures 35 a field indicated by field lines 44; the field represented by lines 44 is polarized in a direction opposite from that represented by field lines 42 so that the blocking field is counteracted by the field identified by lines 44 when photoconductor 33 is in the dark state. Accordingly, within each aperture 35 there is formed a field that passes and in fact enhances the flow of charged particles through screen 22 so long as photoconductive layer 33 is maintained in the dark or unexposed state.

When reverse face 34 of screen 22 is exposed to the image from image source 26, conductive layer 33 is locally discharged in accordance with the intensity and distribution of the image so that each aperture 35, depending on its spatial position, passes or blocks particles in correspondence with the image. Thus, during the duplication interval, when the charged particles are propelled by power source 20 from particle source 18 to medium 16, the particles become arranged before impingement on the medium into a pattern corresponding to that of the image to be reproduced.

The size and spacing of apertures 35 in screen 22, i.e., the relative fineness of the screen, determines the fineness of resolution of the image produced. If the apertures 35 are relatively small and closely spaced, a high degree of resolution of reproduction is achieved; if on the other hand, the apertures are relatively large, the degree of resolution is somewhat lower. An example of a screen that has sufficiently large apertures to afford control of charged particles without the necessity of employing the variable screen bias feature of the present invention is a screen formed of 140-line/inch woven wire mesh, which has 40% open area. An example of a screen the operation of which can be materially improved by employing the variable screen bias feature of the present invention is a screen formed of 300-line/inch woven wire mesh and having a 20% open area.

A characteristic that is related to screen aperture size is the range of electric field variation within a given aperture. More specifically, for a relatively large aperture, a relatively broad range of voltage differentials $V_C$–$V_B$ are required to produce fields within the aperture whose magnitudes range between complete charged particle blocking and maximum charged particle passage. A screen having apertures of this type thus possesses a relatively broad charged particle control range. In contrast, a relatively small aperture requires only a comparatively narrow range of voltage differentials $V_C$–$V_B$ in order to produce fields whose magnitudes range between full charged particle blocking and maximum charged particle passage. A screen having apertures of this type thus possesses a relatively narrow charged particle control range.

Figure 3:
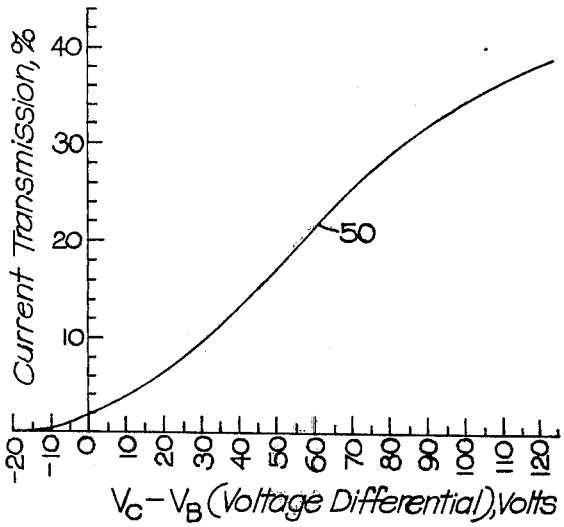
FIG. 3 is a plot of percentage current transmission through the screen versus the net effective bias voltage on the screen.

The response or transmission characteristic of a screen having relatively large diameter apertures, and thus a broad charged particle control range, such as that specifically referred to in the aforecited U.S. patent, is shown in FIG. 3. The ordinate of FIG. 3 represents the ratio expressed as a percentage of the amount of emergent charged particles that pass through the apertures in the screen to the amount of incident charged particles that approach observe face 29 of the screen from source 18. For example, a value of 30 indicates that 30% of the incident particles are transmitted through the screen. The abscissa represents the voltage differential $V_C$–$V_B$, wherein $V_C$ and $V_B$ are as defined above. It will be seen from curve 50, FIG. 3, that when the quantity $V_C$–$V_B$ is −20 volts (assuming that the particles from source 18 are negatively charged), no charged particles pass through apertures so biased. As the value of $V_C$–$V_B$ increases, the percent current transmission increases monotonically at a gradual rate which is nearly linear in the range $-20\text{ V} \leqq V_C - V_B \leqq 120\text{ V}$. Although not depicted in FIG. 3, beyond 120 volts the percent current transmission asymptotically approaches a maximum value of 60% for the particular screen whose characteristic is depicted in the Fig.

Figure 4:
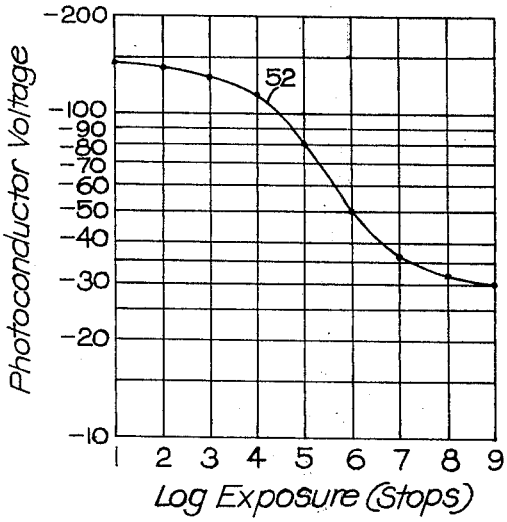
FIG. 4 is a graph of photoconductor voltage on the photoconductive layer of the screen versus the light exposure to which the photoconductive layer is subjected during operation according to the invention.

FIG. 4 illustrates the characteristic of a typical photoconductive material employed for layer 33 on an apertured screen such as that having the characteristics of FIG. 3. In the graph of FIG. 4, the ordinate represents the voltage charge, $V_C$, across photoconductive layer 33 after exposing the layer. The abscissa of the graph of FIG. 4 represents the light exposure to which the photoconductive layer is subjected and is calibrated as the logarithm of the exposure or number of stops. Relatively large values of $V_C$ correspond to relatively dark areas of the image and relatively small values of $V_C$ correspond to relatively light areas of the image. As is evident from the curve of FIG. 4, the monotonic response characteristic of the photo-conductive material provides substantial variation of photo-conductor charge density with increasing exposure between the lower limit of stop 2 and the upper limit of stop 8, corresponding to photo-conductor voltages in the range $140\text{ V} \geqq V_C \geqq 33\text{ V}$. Accordingly, by operating the photoconductive material in this voltage range, an expsoure range having the excellent tonal resolution range of a 6-stop system can be provided.

Comparing the photo-conductive material characteristic of FIG. 4 with the screen characteristic of FIG. 3, it is seen that the desired 6-stop exposure range can be obtained by initially charging the photo-conductive layer of the screen to approximately 140 volts and providing a screen bias voltage $V_B$ of approximately 53 volts during the duplication interval following exposure. From the characteristic of the photo-conductive material, it is seen that the highest possible screen voltage, corresponding to black portions of the original image, is 140 volts, while the lowest possible screen voltage is approximately 33 volts corresponding to white portions of the original image. The screen characteristic illustrates that the selected bias voltage $V_B$ of approximately 53 volts completely blocks transmission of charged particles through screen apertures in white portions of the image ($33-53=-20$ Volts) and enables transmission of approximately 34 percent of the incident charged particles through screen apertures in black portions of the image ($140-53=97$ Volts). In addition, the screen response in the range of voltages over which it is operated ($-20$ V $\leqq V_C-V_B \leqq 97$ V) is nearly linear, so that the charged particle density variation on the copy medium 16 can be a virtual duplicate of the latent image on the screen.

In order to obtain a visible copy having the tonal resolution of the original, however, it is necessary to adjust the integrated charged particle current incident to the screen. This is necessary in order to insure that the charged particle density on a portion of the copy corresponding to a black portion of the original is great enough to develop as a black portion. This may be effected in accordance with a first aspect of the invention in two ways: first, by varying the charged particle emission rate of source 18; second, by varying the duration of the duplication interval.

The integrated charged particle current can be adjusted according to the first method by varying the power supplied by the power source 20 to the charged particle source 18. Means for adjusting the power source 20 are schematically indicated in FIG. 1 by bias control 43. The actual configuration of control 43 depends on the type of charged particle source utilized in a given electrostatic printer. If a high voltage wire corona source is employed as a source 18, control 43 may simply comprise a circuit for varying the magnitude of the high voltage applied to the corona source. If source 18 is charged toner particle source employing an air stream, control 43 may comprise both a voltage varying circuit for accelerating the toner particles into the stream and a means for varying the air flow rate. Other arrangements will occur to those skilled in the art.

In operation, with a latent image on screen 27 voltage $V_B$ is set at a value just sufficient to block the flow of charged particles through white area apertures. Next, the power source is adjusted by means of control 43 until the charged particle density on a portion of the copy medium corresponding to a black portion of the original is sufficient to develop as a black portion. When a charged toner particle source is employed, the charged particle density can be viewed directly. When a non-visible charged particle source is employed, the charged particle density can be rendered visible by applying visible toner particles to the copy.

The integrated charged particle current can be adjusted according to the second method by varying the duration of the duplication interval while keeping the charged particle supply substantially constant. This method proceeds in a similar manner to that discussed above, viz. the voltage $V_B$ is set at a value just sufficient to block the flow of charged particles through white area apertures, after which the duplication interval is adjusted until the charged particle density on a black portion of the copy is sufficient to develop as a purely black portion. Adjustment of duplication interval may be achieved by installing a timing device for controlling the length of the duplication interval.

In some applications, it has been found desirable to provide for adjustment of both the charged particle emission rate and the duplication interval so that full tonal range can be initially achieved with a minimum duplication interval duration. As the emissive efficiency of source 18 deteriorates with prolonged use the duplication interval can then be lengthened to compensate for the reduced density of the changed particles incident to screen 22.

Figure 5:
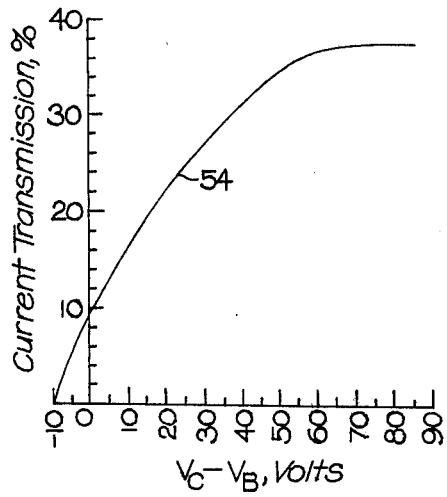
FIG. 5 is a graph of percentage current transmission versus net effective bias voltage on the screen for a screen having a limited charged particle control range.

Finer mesh screens than those having a transmission characteristic similar to that shown in FIG. 3 are desirable for reproducing images with a higher degree of resolution and detail. Allusion has been made hereinabove to the fact that a screen with smaller apertures has a narrower range over which the electrostatic fields within the apertures can be controlled. FIG. 5 depicts in graphic form a typical transmission characteristic of a screen substantially finer, i.e., having apertures substantially smaller, than the screen having the characteristic of FIG. 3. The ordinate and abscissa of FIG. 5 are the same as FIG. 3; from curve 43 in FIG. 5 it will be noted that the voltage range over which the apertures can be controlled to influence passage of charged particles through the apertures extends only from about $-10$ volts to about 60 volts, which corresponds to a voltage range between total blocking of charged particles and maximum passage of charged particles of 70 volts. Until now, utilization of a screen having a response characteristic as shown in FIG. 5 has been limited by certain disadvantages which include sensitivity to noise, inadequate gray scale response (particularly near the light or white portion of the image), and inadequate image density range.

Sensitivity to noise occurs because a small change in the voltage quantity $V_C-V_B$ produces a relatively large change in the percentage of charged particles which are transmitted through a given aperture. Such sensitivity to noise is manifested in the copy or reproduction by graininess or mottling which represent spurious signals that are not found in the original from which the copy of reproduction is made.

Gray scale response of the screen, particularly near the white or highlight end of the curve, is poor because of the steepness of the curve near that extremity, the left-hand extremity as viewed in FIG. 5. Thus tones that are light gray in the original are reproduced as white or substantially white, whereupon the copy or reproduction has a chalky appearance in the light gray portions are reproduced as white.

Inadequate image density range can be appreciated by referring to FIG. 4, in conjunction with FIG. 5 and noting that a 70 volt range across photoconductive layer 33 e.g. 37 volts to 107 volts accomodates an input image density range equivalent to only 3 stops, a range inadequate to reproduce the full tonal variations in the original.

In a second aspect, the present invention overcomes the disadvantages and shortcomings inherent in fine mesh screens as enumerated above in the following manner. During the duplication interval when charged particles are permitted to selectively pass through the apertures in screen 22, the voltage $V_B$ on conductive layer 28 is changed so that the quantity $V_C-V_B$ varies over a range larger than that shown in FIG. 5. Stated otherwise, by employing the present invention with a screen having a transmission characteristic as shown in FIG. 5, the effective response or transmission characteristic of the screen is improved to be substantially that of FIG. 3. According to the invention, photoconductive layer 33 is charged so that the range of $V_C$ thereacross encompasses an adequate image density range (e.g. six stops). Such range of $V_C$ substantially exceeds the response range of the screen. In one system designed according to the present invention, $V_C$ is charged to 160 volts and is exposed until the highlight areas are discharged to 20 volts, thereby affording a range, between the maximum and minimum magnitude of $V_C$, of 140 volts. Such range of variation is twice the range of a screen having the transmission characteristic of FIG. 5. $V_B$ is then established at a first level of 30 volts and power source 20 is activated for a first time interval to propel charged particles from source 18 to medium 16. Thus, apertures within the screen that are associated with areas of the photoconductive layer that are charged in the range of 20 volts to 90 volts control charged particle passage according to the magnitude of the charge, $V_C$, on the photoconductor. Apertures associated with the areas of the photoconductive layer that are charged in the range of 90 volts to 160 volts pass the maximum number of charged particles during the first time interval. This level of operation is permitted to persist for a period less than that required for tonal saturation of the black areas of the pattern. The voltage on conductive layer 36 is then switched to a second level of 100 volts and power source 20 is activated for a second time to propel charged particles from source 18 to medium 16. During this second time interval, apertures associated with portions of the photoconductive layer 33 that are charged at magnitudes ranging from 90 volts to 160 volts will pass charged particles in proportion to the specific magnitude within that range; however, apertures associated with portions of the photoconductive layer that are charged in the range of 20 to 90 volts will totally block passage of charged particles. Thus, during this second interval, the upper portion of the range of charges on the photoconductive layer will be effective to reproduce the corresponding portion of the pattern or image.

Figure 6:
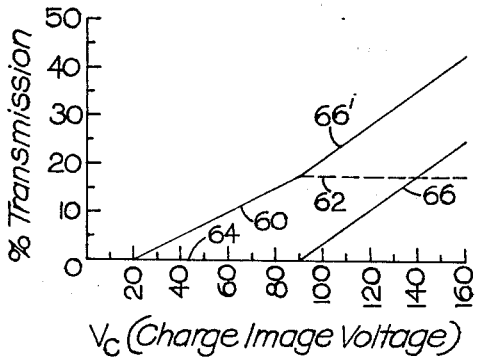
FIG. 6 is a plot of percentage current transmission versus photoconductor voltage for a screen that is operated according to one embodiment of the present invention.

The mode of operation described in the above example is shown graphically in FIG. 6. In FIG. 6, for simplicity, the response curve is depicted as linear rather than curved as in FIG. 5. The ordinate of FIG. 6 is percentage transmission which corresponds to the amount of charged particles passed through the apertures in the screen. The abscissa is calibrated in volts and represents the magnitude of $V_C$ over the reverse face of the screen. During the first interval of operation of the screen, the interval during which $V_B$ is set at 30 volts, the screen passes charged particles in linear relationship to the charge on photoconductive layer 33 on those portions of the photoconductive layer that are charged between 20 volts and 90 volts. Line segment 60 of the curve of FIG. 6 represents this range of operation. During operation of the screen at this interval, all apertures corresponding to locations in which $V_C$ is in the range of 90 to 160 volts pass uniform quantities of charged particles as indicated in line segment 62 in the Figure. During the second time interval, the interval during which $V_B$ is set at 100 volts, apertures associated with areas in which $V_C$ is 20 to 90 volts are biased so as to completely block the passage of charged particles; line segment 64 represents this range. Apertures associated with the screen areas in which $V_C$ ranges from 90 to 160 volts pass charged particles in proportion to the particular value of $V_C$ within the range. Operation in this range is depicted by line segment 66 in FIG. 6. The overall response of the screen when operated in accordance with the invention is represented by the combination of line segment 60 and line segment 66. The latter segment is derived by adding line segment 62 to line segment 66. The overall response of the screen is seen to be substantially linear and is increased insofar as the range of linear operation is concerned.

Figure 7:
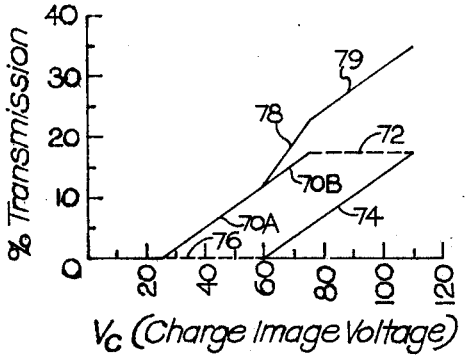
FIG. 7 is a plot of percentage current transmission versus photoconductor voltage for a screen that is operated according to another embodiment of the present invention.

Another example will be helpful in appreciating the operation of this aspect of the present invention. In such example, a screen having a relatively narrow charged particle control range of 50 volts, cutoff voltage of −5 volts, and a saturation voltage of 45 volts is, by employment of the present invention, expanded to respond to an 85 volts range on the photoconductive layer. In operating a screen of the type characterized in FIG. 7, the photoconductive layer 33 is initially charged up to about 110 volts, after which the photoconductive layer is exposed to the image to be reproduced. Black or dark portions of the image will not discharge the photoconductor so that the voltage $V_C$ at such dark areas corresponds to 110 volts whereas light portions will discharge the photoconductive layer to voltage $V_C$ of about 25 volts. Because, as stated above, the screen has a cutoff voltage of −5 volts, $V_B$ is initially set at 30 volts so that the screen operates to permit passage of particles in proportion to the magnitude of $V_C$ in the range of 25 volts to 75 volts. Operation in this range is depicted in FIG. 7 by line segments **70*a* and 70*b*. Apertures associated with areas of the photoconductive layer that are charged at 75 volts and above pass charged particles uniformly irrespective of the particular voltage within such range; operation in this part of the system is depicted by line segment 72** on the graph.

After a first interval of operation as described above, $V_B$ is switched to a second value of 65 volts so that areas of the screen at which the photoconductive layer is charged in the $V_C$ range of 60 volts to 110 volts will pass charged particles in accordance with the value of $V_C$ in such range. Such range is identified in FIG. 7 by line segment 74. Apertures associated with areas of the screen at which the photoconductive layer is charged to a level below 60 volts will block passage of charged particles. This range is designated in FIG. 7 by line segment 76.

The overall response is represented in FIG. 7 by line segment 70A, a second line segment, 78 and a third line segment 79. Line segments 78 and 79 are derived by adding to line segment 74 the respective magnitudes of line segments of 70B and 72.

Figure 9:
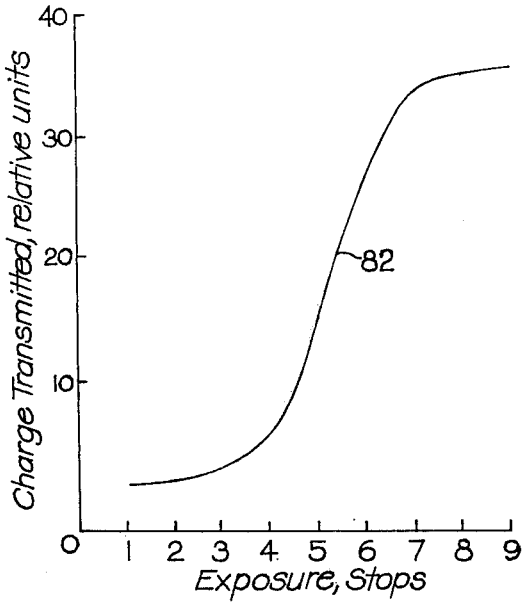
FIG. 9 is a plot of percentage current transmission versus light exposure for a screen operated in accordance with the present invention.
Figure 8:
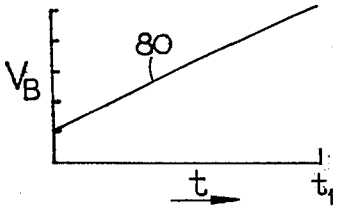
FIG. 8 is a plot of bias voltage versus time for illustrating still another embodiment of the invention.

The examples described hereinabove with respect to FIG. 6 and 7 employ two discreet DC levels at which $V_B$ is set for intervals during the total period of projection of charged particles toward screen 22. Although such mode of operation has been found to provide excellent results in some applications, it is preferred to vary $V_B$ continuously for the period during which charged particles are projected toward the screen. FIG. 8 is a graph or curve 80 of the variation of $V_B$, plotted on the ordinate, with time plotted on the abscissa. Time $t_1$ represents the total period during which charged particles are projected toward the screen; it will be noted that $V_B$ continually and linearly increases during such period. The overall response of a screen biased in accordance with FIG. 8 is shown by curve 82 in FIG. 9 in which the ordinate represents the percentage of charged particle transmission of the screen and the abscissa represents the relative density of the image in stops. It will be noted in curve 82 in FIG. 9 that both extremes, i.e., total blocking of charged particles and maximum passage of charged particles, is approached gradually so that gray tones near the extremes are accurately reproduced.

Figure 10:
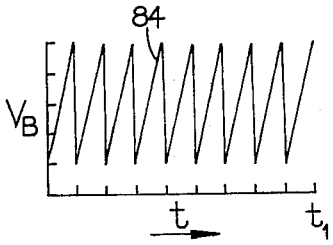
FIG. 10 is a plot of bias voltage versus time for achieving the response characteristic depicted in FIG. 9.

Another mode of operation of a multilayer image forming screen in accordance with this aspect of the present invention is depicted in FIG. 10 which plots $V_B$ over a time period $t_1$ equivalent to that during which the charged particles are projected toward the screen. Operation according to FIG. 10 is substantially identical to that in accordance with FIG. 8 in that $V_B$ resides at any particular magnitude for the same total time. An advantage to using the biasing arrangement of FIG. 10 is that the duration of the total period during which charged particles are directed toward the screen is less critical, because even though one sawtooth wave of FIG. 10 may be cut off by inaccurate timing, insignificant influence on overall response of the screen occurs.

The bias voltage $V_B$ may be varied by utilizing known voltage switching devices. Bias supply 40, e.g., may comprise a source of two voltages of the required magnitudes, and a two-position switch having a common output terminal may be coupled between supply 40 and lead 36 in a known manner to provide the two level bias voltages for the FIG. 6 and 7 embodiments. To provide the linearly swept, single cycle voltage of the FIG. 8 embodiment, and the linearly swept periodic voltage of the FIG. 10 embodiment, known mechanical or electrical voltage sweeping systems may be utilized. Such control devices, being well known, are not shown in detail herein to avoid prolixity, and are schematically depicted in FIG. 1 as bias control 43.

When a relatively fine screen of the type discussed above in conjunction with FIGS. 5–10 is provided with a variable bias $V_B$ to expand the charged particle control range to equal that of a wide aperture screen, the tonal resolution of the visible copy may be improved by adjusting the integrated charged particle current in the manner discussed above in conjunction with FIGS. 3 and 4. Thus, by combining variable screen bias with adjustable integrated charged particle current, visible copies having improved tonal resolution and the inherent fineness of image resolution obtainable with relatively fine screens can be produced.

The gray scale response of an electrostatic printer utilizing a multi-layered apertured screen may be further controlled using the technique of adjusting the bias voltage $V_B$ and the integrated charged particle current to provide a reproduction of an original in which a pair of selected original densities may be reproduced as a pair of selected desired densities which may be the same as or different from the original density values. The ensuing discussion is drawn to the preferred manner of achieving control of the gray scale response in accordance with this technique. The original image to be reproduced is first measured with a scanning densitometer 19 (FIG. 1), or a suitable equivalent instrument, to determine two parameters: firstly, that image density which is to be reproduced as white (which may or may not correspond to a white level in the original image); and secondly, a density lying intermediate the white and black levels to be reproduced as a particular density which may be the same as, or different from, the actual density in the original. After the value of these two parameters are determined, a plot of the FIG. 4 type is consulted to determine the corresponding photoconductor voltages $V_C$. Next, the value of $V_B$ required to completely block transmission of charged particles through screen apertures having photoconductive voltages $V_C$ lying below the preselected white level cutoff is determined from a screen characteristic plot of the type shown in FIGS. 3 and 5. The same plot will also provide an indication of the value of the current transmission of the second density point previously measured. Lastly, the integrated charged particle current is adjusted so that the desired reproduction density will be obtained in those image areas corresponding to image areas in the original having the preselected density. As will be apparent to those skilled in the art, this preselected reproduction image density may be the same, greater or less than the density of the corresponding areas in the original.

Figure 11:
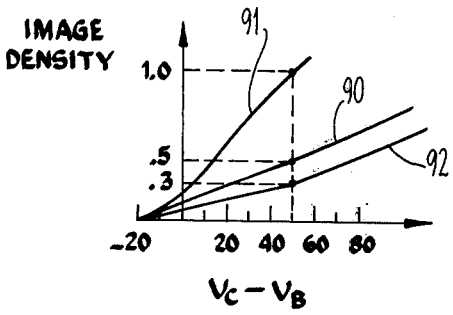
FIG. 11 is a plot of image density versus screen control voltage.

This process is illustrated in FIG. 11 which shows a plot of image density versus net effective screen control voltage for three different values of integrated charged particle current drawn to an arbitrary scale. Curve 90 represents a normal plot of image density versus effective screen bias voltage in which a given photoconductor voltage $V_C$ corresponding to a region on the original having a density of 0.5 is reproduced with the same density. Curve 91 shows the effect of increasing the integrated charged particle current on the same density point. As shown in the FIG., the latent image region corresponding to the region on the original having a density of 0.5 is now reproduced with a density of 1.0. Similarly, curve 92 illustrates the effect on the density point of reducing the integrated charged particle current. As is evident from the FIG., the density of the corresponding region on the reproduced image is lowered to 0.3. As will now be apparent, the effect of adjusting or altering the integrated charged particle current in this manner is to alter the characteristic of the curve of image density versus net effective screen control voltage.

As will be apparent to those skilled in the art, the above described technique may be implemented in a number of equivalent ways. For example, the density measuring instrument may be omitted, if desired, and voltage $V_B$ and the integrated charged particle current may be empirically adjusted until the selected pair of density points in the original are reproduced with the desired densities in the reproduced image.

In summary, the gray scale response of an electrostatic printer utilizing a multilayered apertured screen may be controlled to provide optimum full scale duplicate copies of an original image by varying the integrated charged particle current during the duplication interval and by adjusting the bias voltage $V_B$ in the above described manner. As will now be apparent, even a screen having relatively fine apertures and a correspondingly limited charged particle control range may be operated in such a manner as to provide a broadened gray scale response in excess of that heretofore obtainable with such screens. These techniques are particularly useful when an original image having a broad gray scale range is to be duplicated. In some applications, however, faithful reproduction of the original image leads to relatively undesirable copy. For example, as noted above, an original document which embodies faded text on a dirty background will be reproduced with equally poor quality if the gray scale response of the reproducing device is substantially linear or monotonic over a broad range. By modifying the above described techniques in the following manner, copies can be produced which possess enhanced quality over the original document.

Figure 12:
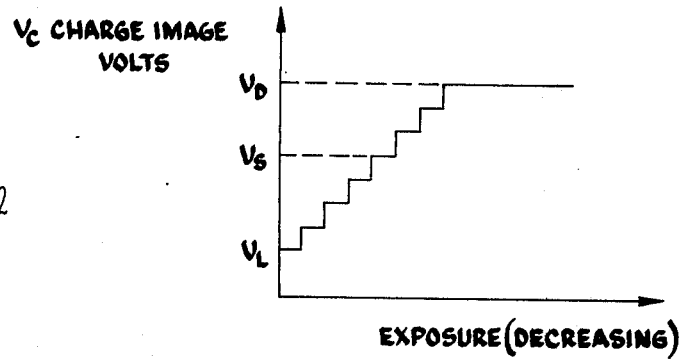
FIG. 12 is a plot of photoconductor voltage $V_C$ versus density of the original image after exposure.
Figure 13:
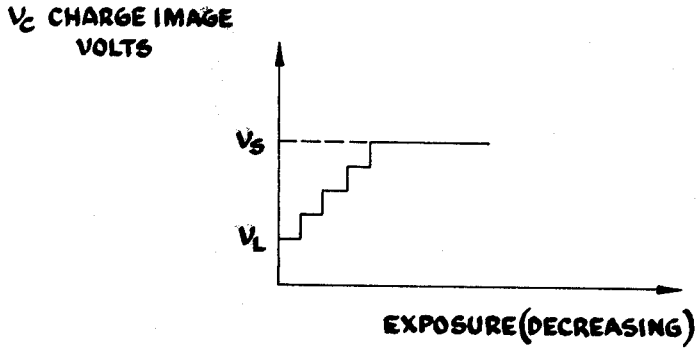
FIG. 13 is a plot of photoconductor voltage $V_C$ versus density after image modification.

In accordance with this aspect of the invention, screen 22 of FIG. 2 is operated in a special saturation mode, hereinafter termed line copy mode, so that portions of the latent electrostatic image having a voltage lying below a preselected value $V_P$ completely block transmission of charged particles therethrough while portions of the image area having a voltage originally lying above a second preselected threshold $V_S$ transmit charged particles through the screen apertures at a uniform rate. Screen 22 is first charged to the maximum photoconductor voltage $V_C$ by source 24 and then is subsequently exposed to the image to be reproduced. After the latent electrostatic image has been impressed upon screen 22, a bias voltage $V_S$ is applied to elements 28, 32 by bias control 43 and bias supply 40. Source 18 or source 24 is next energized to provide an ion current of opposite sign to that of the original ion current used to initially charge screen 22. Due to the presence of bias voltage $V_S$, those portions of photoconductor 33 having a voltage lying above the value of $V_S$ are reduced to this upper limit. FIGS. 12 and 13 illustrate the manner in which the magnitude of the photoconductor voltage $V_C$ is altered when an original image of a variable density discrete bar gray scale is impressed onto screen 22 and screen 22 is operated with bias voltage $V_S$. In both FIGS. the ordinate represents the magnitude of the photoconductor voltage while the abscissa represents the density of the original image. $V_D$ and $V_L$ represent the voltage to which the photoconductor layer 33 is discharged by exposure to the opposite end points of the scale. Thus, in FIG. 12, representing the state of the photoconductor 33 after exposure to the original image, the voltage range on the photoconductor 33 varies between $V_L$ and $V_D$. In FIG. 13, representing the voltages on photoconductor 33 after operation of screen 22 with bias voltage $V_S$, photoconductor 33 exhibits voltages ranging from $V_L$ to $V_S$. Those portions of photoconductor 33 formerly exhibiting voltages above $V_S$ have been discharged to this saturation level. After the photoconductor voltage $V_C$ has been so altered, the biasing voltage is adjusted to a lower density cutoff valve $V_P$ and the duplication interval is commmenced.

Figure 14:
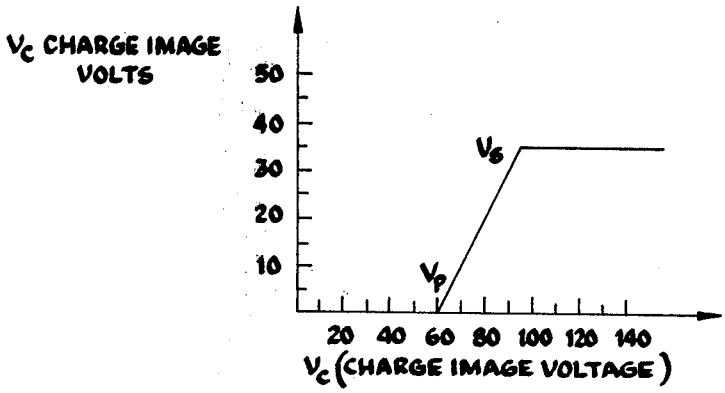
FIG. 14 is a plot of percentage current transmission versus photoconductor voltage for a screen operated in line copy mode.

With reference to FIG. 14, during the ensuing duplication interval, the passage of charged particles through apertures 35 within photoconductor 33 regions having a voltage $V_C$ lying below the bias cutoff voltage $V_P$ is completely blocked. On the other hand, apertures 35 within regions of photoconductor 33 having a voltage $V_C$ corresponding to the saturation voltage $V_S$ transmit charged particles therethrough at a uniform saturation rate. Regions having a voltage $V_C$ lying in the range between $V_P$ and $V_S$ transfer charged particles therethrough at a varying rate depending upon the screen characteristic. It is noted that by choosing a screen 22 having a steep characteristic the transition range from cutoff to saturation can be made extremely narrow. The resulting copy will exhibit well defined dark regions corresponding to the textual material on a white background. The optimum values for $V_S$ and $V_P$ can best be determined on an empirical basis for any particular application. The integrated charged particle current may be adjusted in accordance with the above discussion in order to obtain high density regions for developing the reproduced textual material with the desired degree of blackness.

When operating screen 22 in the line copy mode, it is noted that good original copies, i.e., copies having dark textual material on a white background, are duplicated with the same quality as poor original copies since all image areas having a photoconductor voltage $V_C$ greater than $V_S$ are duplicated with the same intensity. Thus, once adjusted for line copy mode, screen 22 may be used to produce copies of originals of varying quality without regard to the quality of the original. Further, it is understood that documents such as line or block charts, graphs, and the like can also be reproduced during operation in line copy mode with equally successful results.

As will now be apparent, the above described invention enables the production of copies having optimum quality from originals of widely varying quality and nature. When operating in the gray scale mode, the invention provides duplicate copies having a fineness of tonal resolution superior to that hitherto obtainable and a uniformity or faithfulness of tonal reproduction likewise. When operating in the line copy mode, the invention enables the production of duplicate copies of superior quality to the original document.

It is to be understood that the specific embodiments described hereinabove are by way of example only and that various biasing arrangements can be employed. For example, waves shaped different from linear or sawtooth waves can be employed during full gray scale operation without departing from the teachings of the invention. Moreover, in systems employing two or more levels of DC bias the bias ranges can overlap as in FIG. 7, the ends of the bias ranges can be coincident as FIG. 6 or there can be a gap between the two or more bias ranges. Further, it is understood that the examples of voltage magnitudes described are by way of illustration only. The specific quality of reproduction desired and the specific screen characteristics will dictate which particular biasing system is most desirable.

For purposes of simplicity, the disclosure of the invention has been restricted up to this point to a system and method for producing a positive tonal reproduction of the original image. However, the same principles extend to the reproduction of a negative image from a positive original and a positive image from a negative original. For example, to produce a negative image reproduction of a positive original, the polarity of the latent image on photoconductive layer 33 must be the same as the polarity of the charged particles projected through the apertures in screen 22. Thus, either the polarity of both $V_B$ and of $V_C$ or the polarity of the charged particles from source 18 may be changed in the above described system to effect a positive to negative mode of reproduction. Negative to positive reproduction may be effected likewise. It is noted that when the mode of reproduction is inverse, the roles of the range limits are reversed. For example, in line copy mode with a positively charged latent image on photoconductive layer 33 and positive charged particles being supplied by source 18, the passage of charged particles through apertures 35 within photoconductor 33 regions having a voltage $V_C \geqq$ voltage $V_S$ is completely blocked. Correspondingly, apertures 35 within regions of photoconductor 33 having a voltage $V_C \leqq$ voltage $V_P$ transmit charged particles therethrough at a uniform saturation rate. Thus, in the inverse line copy mode, $V_S$ becomes the bias cutoff voltage while $V_P$ becomes the bias saturation voltage. The same analysis applies to the reproduction of a positive image from a negative latent image.

Although several embodiments of the invention have been shown and described, it will be obvious that other adaptations and modifications can be made without departing from the true spirit and scope of the invention.

What is claimed is:

1. The method of limiting the gray scale response of an electrostatic printer having a multilayered apertured screen comprising a photoconductive layer and at least two electrically conductive layers separated by an insulator for receiving an electrostatic latent image of a source image, a source for projecting charged particles toward said screen for modulated transmission therethrough towards a copy medium in accordance with said latent image, a voltage supply for providing an internal bias voltage said first and second conductive layers of said screen and means for controlling the magnitude of said bias voltage, said method comprising the steps of:

(a) impressing an electrostatic latent image on said screen; thereafter (b) adjusting said control means to provide a bias voltage of a first magnitude $V_S$ corresponding to a first image density limit; thereafter (c) altering said latent electrostatic image by directing charged particles toward said screen for an interval sufficient to limit the density producible by said latent electrostatic image to said first limit; thereafter (d) adjusting said bias voltage control means to provide an internal bias voltage of a second magnitude $V_P$ corresponding to a second image density limit; and thereafter (e) directing charged particles toward said screen for duplication interval, the passage of said charged particles during said duplication interval through the screen apertures in areas of image density ranging beyond one of said first and second limits being blocked by the corresponding one of said bias voltages $V_P$, $V_S$ and the passage of charge particles through the screen apertures in areas of image density corresponding to the other of said first and second limits being substantially uniform over the screen image area.

2. The method of claim 1 further including the step of adjusting the integrated charged particle current transmitted during said duplication interval through screen apertures having image densities corresponding to other of said first and second limits to provide a copy image having a selected charge density in regions corresponding to said other density limit portions of the image on said screen.

3. The method of claim 2 wherein said selected charge density corresponds to the black level.

4. A method for limiting the gray scale response of electrostatic printing through a multilayered apertured screen capable of producing continuous variations in density of charged particles directed through said screen, said screen including a photoconductive layer, a first electrically conductive layer for establishing a reference potential of said photoconductive layer, and a second electrically conductive layer insulated by a dielectric layer from said first conductive layer for providing an internal bias potential relative to said reference layer, said method comprising:

altering portions of said electrostatic latent image corresponding to source image densities outside a selected first source image density extremum to produce a fixed print density for all source densities outside said extremum;

applying an internal screen bias voltage between said first conductive screen and said second conductive screen establishing a minimum selected charged particle accumulation corresponding to all print image densities which would otherwise be outside a print density corresponding to a second selected source image density; and thereafter directing an integrated charged particle current of selected rate and duration toward said screen, the accumulation of charged particles beyond said screen producing a gray scale distribution between said selected minimum and maximum print image densities.

5. The method of claim 4 wherein each source image density produces a latent image potential and wherein each latent image potential directly corresponds to a source image density, and further wherein the step of altering said latent image comprises: (i) providing a preliminary screen bias voltage corresponding to said first extremum; and (ii) directing charged particles of a predetermined polarity relative to said latent image toward said screen for a period of time sufficient to modify image potentials outside said first extremum to said first extremum.

6. A method for limiting the gray scale response of electrostatic printing through a multilayered aperture screen capable of producing a continuous density distribution of charged particles directed through said screen, said screen including a photoconductive layer, a first electrically conductive layer for establishing a reference potential of said photoconductive layer, and a second electrically conductive layer insulated by a dielectric layer from said first conductive layer for providing an internal bias potential relative to said reference layer, said method comprising:

establishing an electrostatic latent image upon said photoconductive layer;

altering portions of said electrostatic latent image corresponding to source image densities greater than a selected maximum source image density to produce a fixed print density for all source densities greater than said maximum source image density;

applying an internal screen bias voltage between said first conductive screen and said second conductive screen establishing a minimum selected charged particle accumulation corresponding to all print image densities which would otherwise be less than a print density corresponding to a second selected source image density; and thereafter directing an integrated charged particle current of selected rate and duration toward said screen, the accumulation of charged particles beyond said screen having a gray scale distribution between said selected minimum and maximum print image densities.

7. A method for limiting the gray scale response of electrostatic printing through a multilayered apertured screen capable of producing a continuous density distribution of charged particles directed through said creen, said screen including a photoconductive layer, a first electrically conductive layer for establishing a reference potential of said photoconductive layer, and a second electrically conductive layer insulated by a dielectric layer from said first conductive layer for providing an internal bias potential relative to said reference layer, said method comprising:

establishing an electrostatic latent image upon said photoconductive layer;

altering portions of said electrostatic latent image corresponding to source image densities less than a selected minimum source image density to produce a fixed print density for all source densities less than said minimum source image density;

applying an internal screen bias voltage between said first conductive screen and said second conductive screen establishing a minimum selected charged particle accumulation corresponding to all print image densities which would otherwise be less than a print image density corresponding to a second source image density; and thereafter directing an integrated charged particle current of selected rate and duration toward said screen, the accumulation of charged particles beyond said screen having a gray scale distribution between said selected minimum an maximum print image densities.

* * * * *